US007670014B2

(12) United States Patent
Parness et al.

(10) Patent No.: US 7,670,014 B2
(45) Date of Patent: Mar. 2, 2010

(54) INFANT VIEWING AUTO MIRROR

(75) Inventors: Michael A. Parness, San Diego, CA (US); Sarah J. Attwood, San Diego, CA (US); Kenneth B. Krankkala, Vista, CA (US)

(73) Assignee: Infantino, LLC, San Diego, CA (US)

( * ) Notice: Subject to any disclaimer, the term of this patent is extended or adjusted under 35 U.S.C. 154(b) by 275 days.

(21) Appl. No.: 11/749,055

(22) Filed: May 15, 2007

(65) Prior Publication Data

US 2008/0287032 A1 Nov. 20, 2008

(51) Int. Cl.
*G02B 7/182* (2006.01)

(52) U.S. Cl. ..... 359/844; 359/871; 248/489

(58) Field of Classification Search ..... 359/838, 359/844, 871, 872; 248/489
See application file for complete search history.

(56) References Cited

U.S. PATENT DOCUMENTS

| | | | | |
|---|---|---|---|---|
| 4,702,572 | A | 10/1987 | Cossey | |
| 4,712,892 | A | 12/1987 | Masucci | |
| 4,733,956 | A | 3/1988 | Erickson | |
| 4,902,118 | A | 2/1990 | Harris | |
| 4,909,618 | A | 3/1990 | Gardner | |
| 5,103,347 | A | 4/1992 | Lumbra | |
| 5,285,321 | A | 2/1994 | Nolan-Brown | |
| 5,576,898 | A | 11/1996 | Rubin | |
| 6,039,455 | A | 3/2000 | Sorenson | |
| 6,120,155 | A | 9/2000 | Brennan | |
| 6,283,622 | B1 * | 9/2001 | Chupp et al. | 362/492 |
| 6,305,810 | B1 | 10/2001 | Mercado | |
| 6,354,708 | B1 | 3/2002 | Monahan | |
| 6,478,435 | B2 * | 11/2002 | Monahan et al. | 359/872 |
| 6,913,364 | B2 | 7/2005 | Kane | |
| 6,997,567 | B1 * | 2/2006 | Caruso | 359/872 |
| 2004/0160686 | A1 * | 8/2004 | Nolan-Brown | 359/871 |
| 2004/0190167 | A1 * | 9/2004 | Berger | 359/879 |

* cited by examiner

*Primary Examiner*—Alessandro Amari
*Assistant Examiner*—Mark Consilvio
(74) *Attorney, Agent, or Firm*—Stetina Brunda Garred & Brucker

(57) ABSTRACT

An infant viewing auto mirror comprising a main panel having a reflective surface (i.e., mirror) exposed in the front side or surface thereof, and a flap affixed to the rear surface thereof. The flap is releasably secured to the rear surface of the main panel through the use of complimentary snaps. In addition to the main panel, the auto mirror comprises a mounting strap which is extensible about and removably attachable to a headrest through the use of a strip of Velcro disposed adjacent one end of the strap which is itself releasably engageable to a portion of the strap adjacent the opposite end thereof. Protruding from one side of the strap in the approximate center thereof is a dome-shaped support fabricated from hard foam. Extending diametrically across the support is a strip of fabric material. When the strap is properly secured to the headrest, the foam support (and hence the strip) is forwardly presented. The main panel is cooperatively engaged to the strap by advancing or "threading" the flap of the main panel between the fabric strip and foam support of the strap, the main panel being maintained in releasable engagement to the strap by thereafter snapping the flap to the rear surface of the main panel.

16 Claims, 4 Drawing Sheets

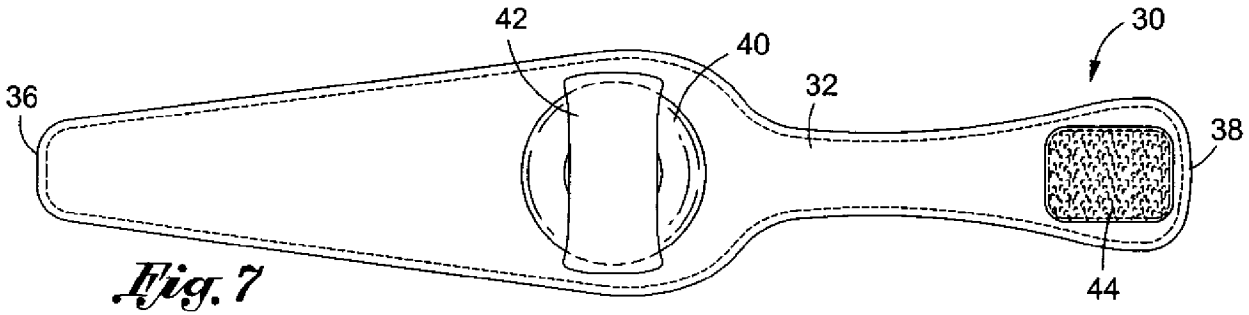
Fig. 7
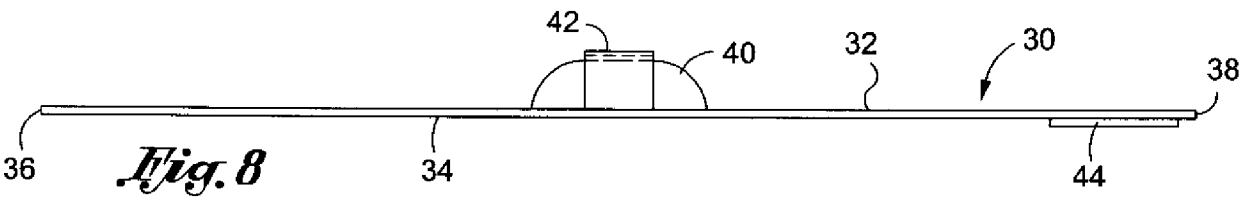
Fig. 8
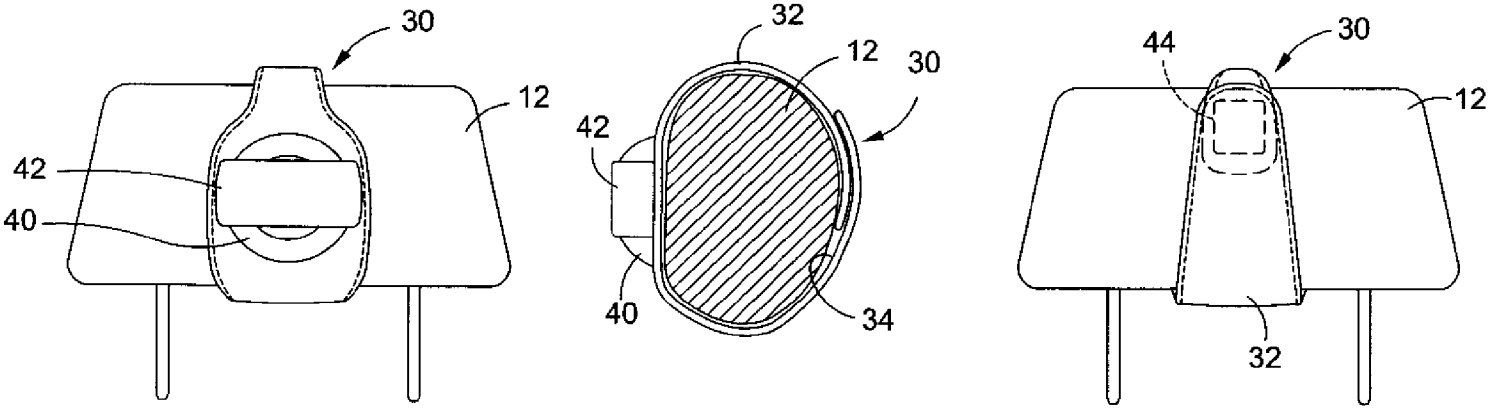
Fig. 11
Fig. 10
Fig. 9

INFANT VIEWING AUTO MIRROR

STATEMENT RE: FEDERALLY SPONSORED RESEARCH/DEVELOPMENT

Not Applicable

CROSS-REFERENCE TO RELATED APPLICATIONS

Not Applicable

BACKGROUND OF THE INVENTION

1. Field of the Invention

The present invention relates generally to the field of automotive safety, and more particularly to an infant viewing auto mirror device which permits the driver of a vehicle to observe the position and condition on an infant occupant on the rear seat of the vehicle.

2. Description of the Related Art

Current governmental regulations require that an infant traveling in a vehicle be secured in a car safety seat that is itself fastened to the rear seat of the vehicle through the use of the vehicle's seatbelt. It has become a common practice as a result of the recommendations of child safety advocates to position the car safety seat such that the infant faces the rear of the vehicle. Indeed, many child protection groups have stated that this form of travel is recommended for babies up to twelve months of age and/or twenty pounds in weight, whichever comes first.

Most infant safety seats as currently known in the art include a high back or are constructed with side panels that often obstruct any view of the infant when the infant is in the safety seat facing rearward. Thus, in many instances, the infant is not readily visible to the driver of the vehicle or to the occupant of the vehicle adjacent to the driver. Since the position and condition of the infant is not observable by occupants of the front seats, the infant's needs and condition are not readily discernable. As a result, when the driver or passenger in the front seats of the vehicle wishes to or needs to observe or check on the condition of the infant in the safety seat, the driver or passenger must turn his/her body and lean back over the front seat. This procedure is not only inconvenient, but dangerous should the driver be the one attempting to observe the infant since the driver will be forced to take his/her eyes off the road. Although the driver or passenger in the front seats may attempt to use either the rear view mirror or the visor mirror to observe the infant so positioned on the rear seat, such practice is awkward and not well suited to providing a clear view of the infant. If the driver is alone, the driver is often put into the position of having to stop the vehicle and perhaps even get out of the same in order to check on the infant. This practice is also inconvenient at best, and dangerous at worst if there is no safe roadside location to which the driver may safely drive the vehicle.

In recognition of the foregoing, various prior art devices have been developed in attempt to provide a modality by which a rearwardly facing infant may be viewed or observed in a car safety seat. Such devices are disclosed, for example, in U.S. Pat. No. 4,702,572 to Cossey; U.S. Pat. No. 4,712,892 to Masucci; U.S. Pat. No. 4,733,956 to Erickson; U.S. Pat. No. 4,902,118 to Harris; U.S. Pat. No. 4,909,618 to Gardner; U.S. Pat. No. 5,103,347 to Lumbra et al.; U.S. Pat. No. 5,285,321 to Nolan-Brown; U.S. Pat. No. 5,576,898 to Rubin; U.S. Pat. No. 6,039,455 to Sorenson; U.S. Pat. No. 6,120,155 to Brennan et al.; U.S. Pat. No. 6,305,810 to Mercado; U.S. Pat. No. 6,354,708 to Monahan et al.; and U.S. Pat. No. 6,913,364 to Kane.

Though the devices disclosed in the above-identified patents address the need for viewing a rearwardly facing infant in a car safety seat, these devices possess certain deficiencies which detract from their overall utility. These deficiencies include, among other things, insufficiencies in the size of the reflective surface of the device, and inferior mounting systems which make the attachment of the device to the vehicle seat in the proper orientation a time consuming, cumbersome process. The present invention addresses these and other deficiencies of the prior art viewing devices by providing an infant viewing auto mirror which is configured for quick and easy attachment to an existing rear vehicle seat and is further configured to provide an optimal viewing angle to the infant within the car seat. These, as well as other advantages attendant to the present invention will be discussed in more detail below.

BRIEF SUMMARY OF THE INVENTION

In accordance with the present invention, there is provided an infant viewing auto mirror comprising a main panel having a reflective surface (i.e., mirror) exposed in the front side or surface thereof, and a flap affixed to the rear surface thereof. More particularly, the flap is releasably secured to the rear surface of the main panel through the use of complimentary snaps. Alternatively, one end of the flap may be secured to the rear surface of the main panel by stitching, with the opposite end being releasably attachable to the rear surface through the use of the complimentary snaps.

In addition to the main panel, the auto mirror of the present invention comprises a mounting strap which is extensible about and removably attachable to a headrest through the use of a strip of Velcro disposed adjacent one end of the strap which is itself releasably engageable to a portion of the strap adjacent the opposite end thereof. Protruding from one side of the strap in the approximate center thereof is a dome-shaped support fabricated from hard foam. Extending diametrically across the support is a strip of fabric material. When the strap is properly secured to the headrest, the foam support (and hence the strip) is forwardly presented. The main panel is cooperatively engaged to the strap by advancing or "threading" the flap of the main panel between the fabric strip and foam support of the strap, the main panel being maintained in releasable engagement to the strap by thereafter snapping the flap to the rear surface of the main panel.

The present invention is best understood by reference to the following detailed description when read in conjunction with the accompanying drawings.

BRIEF DESCRIPTION OF THE DRAWINGS

These, as well as other features of the present invention, will become more apparent upon reference to the drawings wherein:

FIG. 7 is a top plan view of the mounting strap of the auto mirror of the present invention;

FIG. 8 is a side elevational view of the mounting strap shown in FIG. 7;

FIG. 9 is a front elevational view of the mounting strap shown in FIGS. 7 and 8 as operatively coupled to the headrest of a rear vehicle seat prior to the interface of the main panel thereto;

FIG. 10 is a side elevational view of the mounting strap shown in FIGS. 7 and 8 as operatively coupled to the headrest of a rear vehicle seat prior to the interface of the main panel thereto;

FIG. 11 is a rear elevational view of the mounting strap shown in FIGS. 7 and 8 as operatively coupled to the headrest of a rear vehicle seat prior to the interface of the main panel thereto.

Common reference numerals are used throughout the drawings and detailed description to indicate like elements.

DETAILED DESCRIPTION OF THE INVENTION

Figure 1:
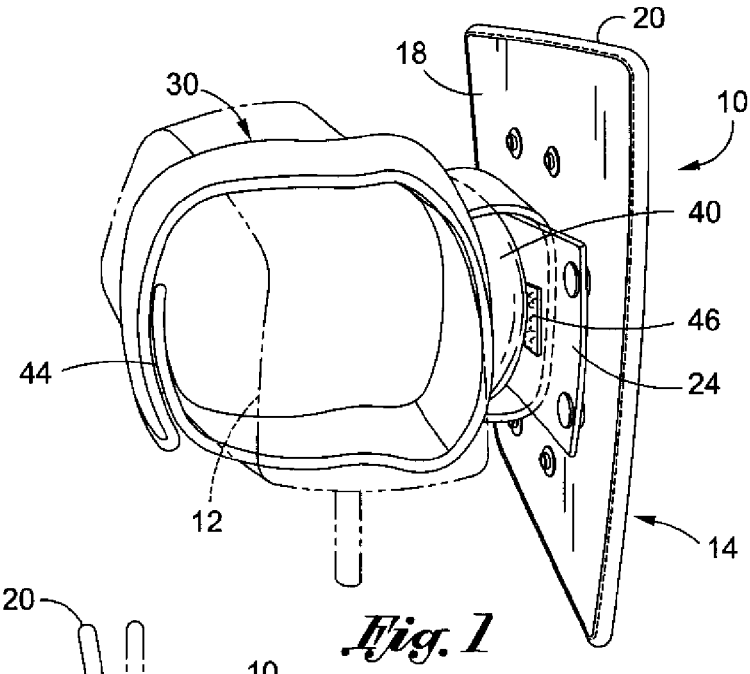
FIG. 1 is a rear perspective view of the infant viewing auto mirror constructed in accordance with the present invention as operatively coupled to the headrest of a rear vehicle seat.
Figure 2:
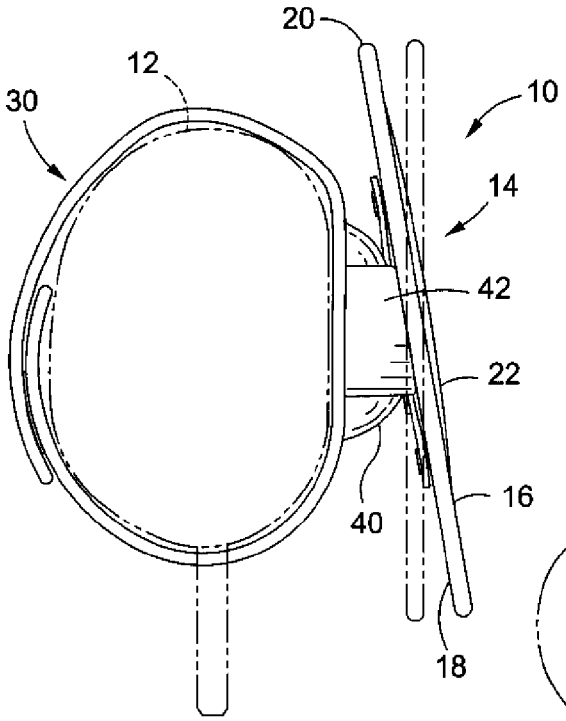
FIG. 2 is a side elevational view of the auto mirror of the present invention as operatively coupled to the headrest of a rear vehicle seat, further illustrating the manner in which the main panel of the auto mirror is vertically adjustable relative to the mounting strap thereof.
Figure 3:
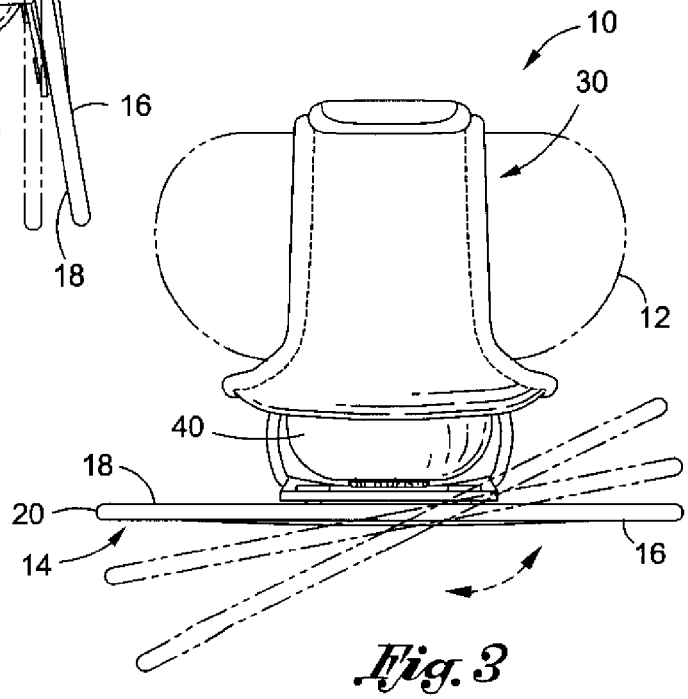
FIG. 3 is a top plan view of the auto mirror of the present invention as operatively coupled to the headrest of a rear vehicle seat, further illustrating the manner in which the main panel of the auto mirror is horizontally adjustable relative to the mounting strap thereof.
Figure 4:
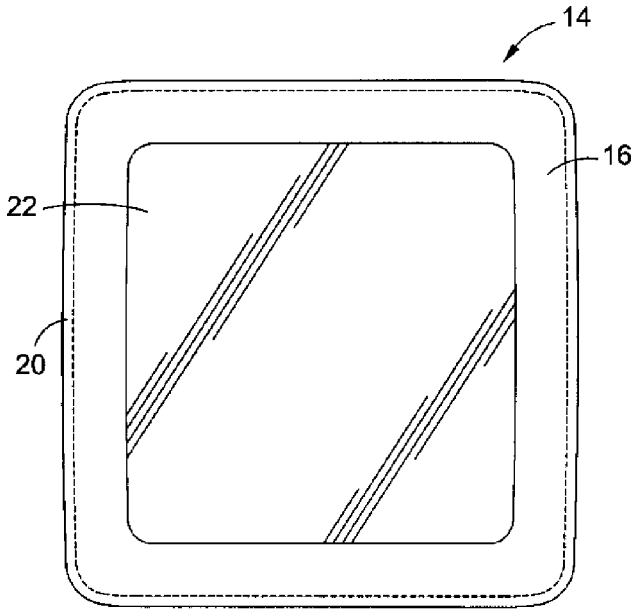
FIG. 4 is a front elevational view of the main panel of the auto mirror of the present invention.
Figure 6:
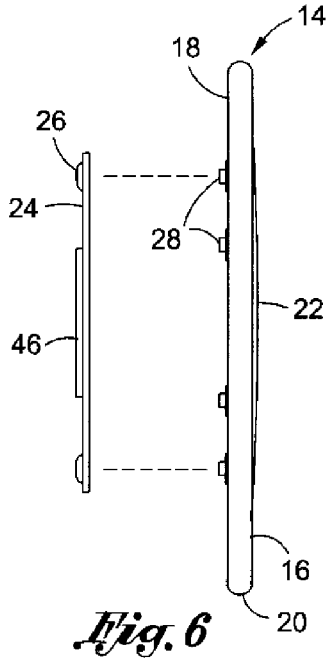
FIG. 6 is a side elevational view of the main panel shown in FIGS. 4 and 5.
Figure 5:
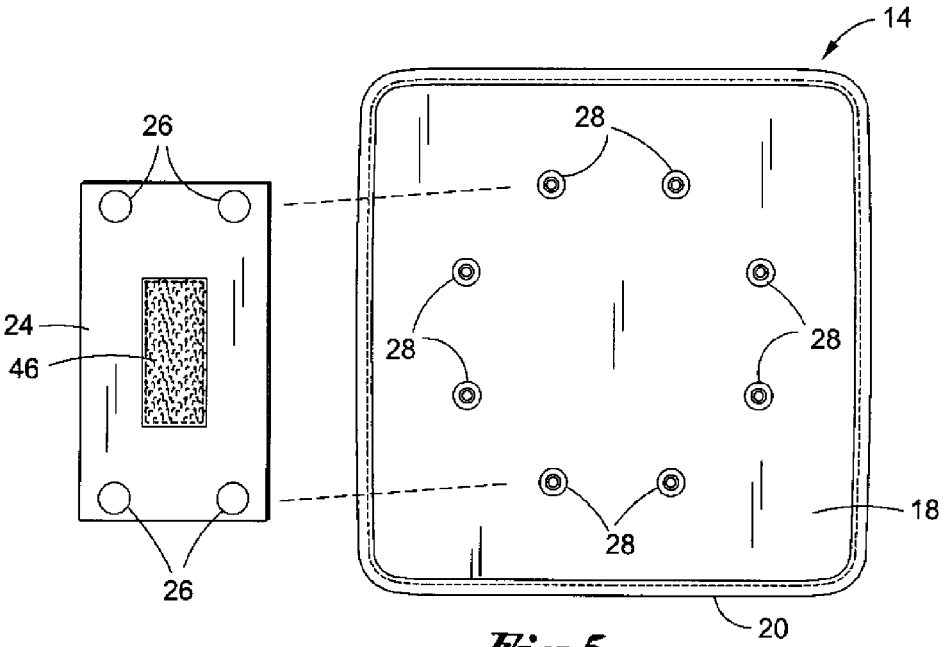
FIG. 5 is a rear elevational view of the main panel shown in FIG. 4.

Referring now to the drawings wherein the showings are for the purposes of illustrating a preferred embodiment of the present invention only, and not for purposes of limiting the same, FIGS. 1-3 illustrate an infant viewing auto mirror 10 constructed in accordance with the present invention as operatively coupled to the headrest 12 of a rear vehicle seat. The auto mirror 10 comprises a main viewing panel 14 which is shown in FIGS. 4-6. The main panel 14 defines a generally planar front face or surface 16 and an opposed, generally planar rear face or surface 18. Extending between the front and rear surfaces 16, 18 is a continuous, peripheral side edge 20. Embedded within the front surface 16 of the main panel 14 is a mirror 22. As best seen in FIG. 4, the observable portion of the reflective surface defined by the mirror 22 does not extend all the way to the side edge 20. Rather, the observable portion of the reflective surface of the mirror 22 is circumvented or framed by an opaque, non-reflective portion of the main panel 14 which partially defines the front surface 16 thereof. In the preferred embodiment of the present invention, the mirror 22 is not fabricated from glass for safety reasons. In the auto mirror 10 of the present invention, it is contemplated that the main panel 14, with the exception of the mirror 22, will be fabricated form suitably joined layers of a fabric material, such layers defining respective ones of the rear surface 18 and that portion of the front surface 16 covering the peripheral portion of the mirror 22.

The auto mirror 10 further comprises a flap 24 which is releasable attachable to the rear surface 18 of the main panel 14. As best seen in FIG. 5, the flap 24 has a generally rectangular configuration defining opposed pairs of laterally and longitudinally extending peripheral edge segments. Attached to the flap 24 is a plurality of snap connectors 26. The snap connectors 26 are arranged as two pairs, with the two snap connectors 26 of each pair being disposed adjacent to a respective one of the laterally extending peripheral edge segments defined by the flap 24. In the auto mirror 10, the snap connectors 26 of each pair included on the flap 24 are releasably engageable to respective pairs of complementary, corresponding snap connectors 28 which are directly attached to the rear surface 18 of the main panel 14. As is also shown in FIG. 5, four pairs of the snap connectors 28 are preferably included on the rear surface 18 of the main panel 14. These four pairs of the snap connectors 28 are arranged so as to allow for the releasable attachment of the flap 24 to the rear surface 18 in the orientation shown in FIG. 5, or for the alternative releasable attachment of the flap 24 to the rear surface 18 in an orientation wherein the flap 24 is rotated approximately 90 degrees from that orientation shown in FIG. 5. Though not shown, one end of the flap 24 may alternatively be secured to the rear surface 18 of the main panel 14 by stitching, with the opposite end being releasably attachable to the rear surface 18 through the use of the complimentary snap connectors 26, 28. The flap 24 is preferably fabricated from two layers of a fabric material which are joined to each other and include a generally planar, semi-rigid support structure (e.g., a sheet of flexible plastic) captured therebetween. Those of ordinary skill in the art will recognize that the particular number and arrangement of snap connectors 26, 28 shown in FIG. 5 is exemplary only, and that different numbers and/or arrangements of such snap connectors 26, 28 is contemplated to be within the spirit and scope of the present invention, as are other fasteners other than for the snap connectors 26, 28.

Referring now to FIGS. 7-11, the auto mirror 10 further comprises an elongate, pliable mounting strap 30 which is releasably engageable to the headrest 12. The mounting strap 30 defines an outer surface 32, and an opposed inner surface 34. The mounting strap 30 further defines a first end 36 and an opposed second end 38. Attached to the outer surface 32 substantially intermediate the first and second ends 36, 38 is a generally semi-spherical, dome-shaped support member 40 which is preferably fabricated from a hard, foam-like material. In the mounting strap 30, the hard foam-like core of the support member 40 is covered by a fabric layer which is stretched thereover. Thus, the support member 40 is formed by the combination of the hard foam-like core and corresponding fabric layer covering the same. As best seen in FIG. 9, also included in the mounting strap 30 is an elongate, generally rectangular fastening strip 42 which is also preferably fabricated from a suitable fabric material and is attached to the outer surface 32. More particularly, the opposed ends of the fastening strip 42 are attached to the outer surface 32 such that the fastening strip 42 extends generally diametrically across the support member 40 and further extends in generally parallel relation to each of the first and second ends 36, 38 of the mounting strap 30. Also included in the mounting strap 30 is a patch 44 of hook and loop fastener material (e.g., Velcro) which is affixed to the inner surface 34 in close proximity to the second end 38 thereof as best shown in FIGS. 7 and 8. As indicated above, with the exception of the core of the support member 40 and the fastening patch 44, the mounting strap 30 is fabricated from a fabric or cloth-like material of sufficient pliability so as to be capable of being wrapped about the headrest 12 as will be discussed in more detail below.

The auto mirror 10 of the present invention is cooperatively engaged to the headrest 12 of the rear vehicle seat by initially wrapping the mounting strap 30 about the headrest 12 in the manner shown in FIGS. 9-11. As shown in FIGS. 9-11, the mounting strap 30 is vertically wrapped about the headrest 12, thus causing the fastening strip 42 to assume a generally horizontal orientation relative thereto. More particularly, the inner surface 34 of the mounting strap 30 is brought into direct engagement with the headrest 12 such that the support member 40 and fastening strip 42 are forwardly presented. The inner surface 34 of the mounting strap 30 is maintained in a tight, wrapped engagement to the headrest 12 by the engagement of the patch 44 on the inner surface 34 to a potion of the outer surface 32 adjacent the first end 36 in the manner best shown in FIGS. 2, 10 and 11.

Subsequent to the attachment of the mounting strap 30 to the headrest 12 in the aforementioned manner, the flap 24, as detached from the rear surface 18 of the main panel 14, is advanced or "threaded" between the fastening strip 42 and the support member 40. More particularly, the flap 24 is oriented such that the snap connectors 26 disposed thereon lie outside of and are thus not covered by the fastening strip 42. Thereafter, the snap connectors 26 of the flap 24 are snapped to corresponding pairs of the snap connectors 28 on the rear surface 18 of the main panel 14 to facilitate the operative connection of the main panel 14 to the flap 24, and hence the mounting strap 30, in the manner shown in FIGS. 1-3.

As is best shown in FIGS. 2 and 3, subsequent to the reattachment of the main panel 14 thereto, the flap 24 is capable of being moved or shifted relative to the support member 40 and fastening strip 42 as needed to make adjustments to the vertical orientation of the main panel 14 relative to the headrest 12 (FIG. 2) and/or the horizontal orientation of the main panel 14 relative to the headrest 12 (FIG. 3). Though not shown, it is contemplated that the surface of the flap 24 which is disposed closest to the support member 40 may optionally include a patch 46 of hook and loop fastener material disposed thereon to engage the support member 40 in a manner effectively maintaining the flap 24 and hence the main panel 14 attached thereto in a prescribed orientation relative to the mounting strap 30.

Figure 12:
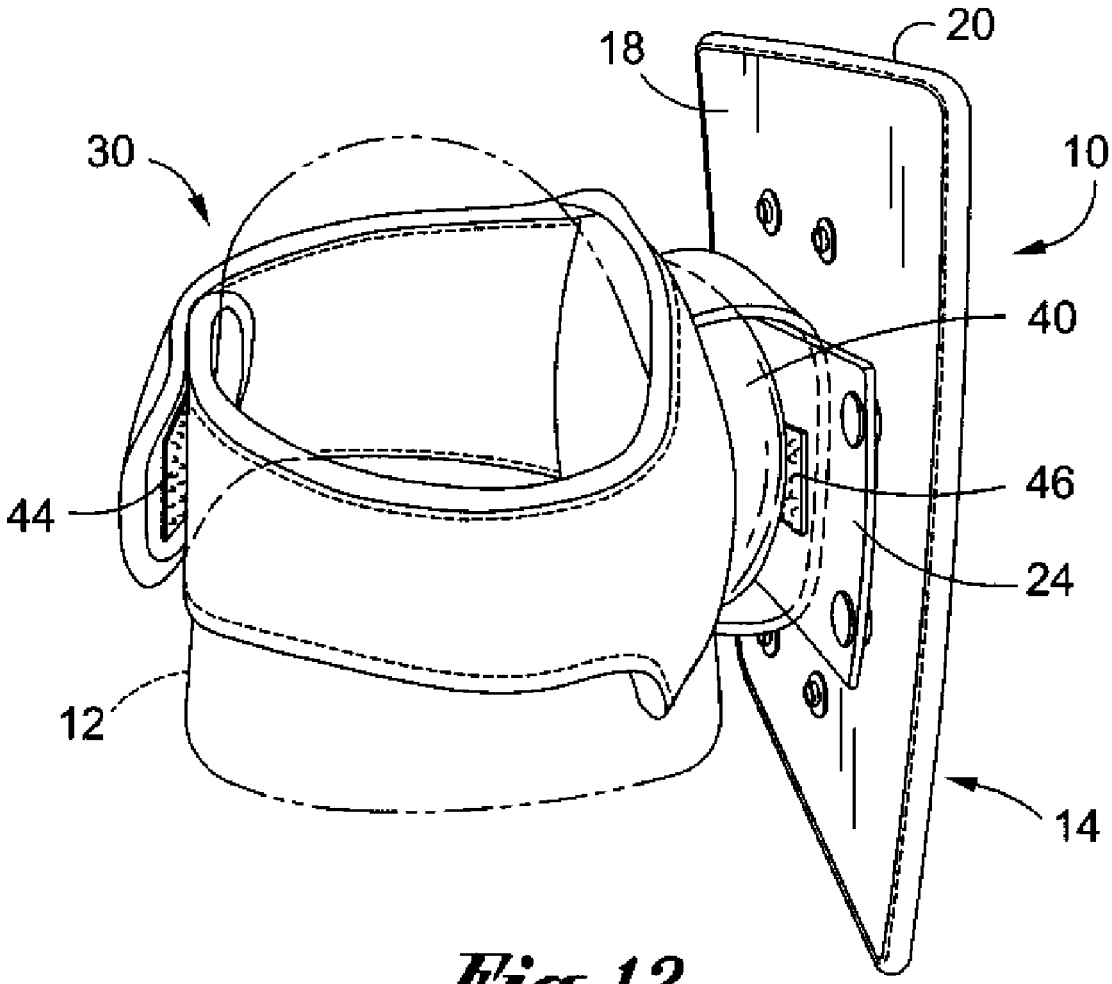
FIG. 12 is a rear perspective view of the infant viewing auto mirror constructed in accordance with the present invention illustrating an alternative manner of operatively coupling the same to the headrest of a rear vehicle seat.

In certain older model vehicles, the headrest 12 of the rear vehicle seat may not be vertically adjustable, but rather maintained in a fixed position relative to the remainder of the rear vehicle seat. In this circumstance, the auto mirror 10 of the present invention may be cooperatively engaged to such fixed headrest 12 by initially wrapping the mounting strap 30 about the headrest 12 in the manner shown in FIG. 12. As shown in FIG. 12, the mounting strap 30 is horizontally wrapped about the fixed headrest 12, thus causing the fastening strip 42 to assume a generally vertical orientation relative thereto. Subsequent to the attachment of the mounting strap 30 to the fixed headrest 12 in the manner shown in FIG. 12, the cooperative engagement of the main panel 14 to the mounting strap 30 is accomplished in the above-described manner.

It is further contemplated that the auto mirror 10 constructed in accordance with the present invention may also be mounted to the headrest of a front vehicle seat. In this regard, when the infant gets older and the rear facing baby seat is now facing forward, the auto mirror 10 can be attached to the front headrest as well to provide a source of entertainment for the forwardly facing infant in the baby seat. Along these lines, though not shown, the rear surface 18 of the main panel 14 may optionally be provided with one or more loops which allow for the attachment of one or more toys to the main panel 14 as further enhances its entertainment value when attached to the headrest of the front vehicle seat.

This disclosure provides an exemplary embodiment of the present invention. The scope of the present invention is not limited by this exemplary embodiment. Numerous variations, whether explicitly provided for by the specification or implied by the specification, such as variations in structure, dimension, type of material and manufacturing process may be implemented by one of skill in the art in view of this disclosure.

What is claimed is:

1. An infant viewing auto mirror for attachment to a headrest on a rear vehicle seat, the auto mirror comprising:

a main panel having opposed front and rear surfaces and a mirror embedded in the front surface thereof;

a flap attached to the rear surface of the main panel; and a mounting strap removably attachable to the headrest, the mounting strap comprising a support member having a fastening strip extending thereacross;

the flap being advanceable between the fastening strip and the support member to facilitate the cooperative engagement of the main panel to the mounting strap.

2. The auto mirror of claim 1 wherein the flap is releasably attached to the rear surface of the main panel.

3. The auto mirror of claim 2 wherein:

the flap includes a plurality of snap connectors disposed thereon; and the rear surface of the main panel includes a plurality of snap connectors disposed thereon;

the cooperative engagement of the snap connectors of the flap to respective ones of the snap connectors of the main panel facilitating the releasable attachment of the flap to the main panel.

4. The auto minor of claim 3 wherein:

the flap includes two pairs of the snap connectors disposed thereon; and the rear surface of the main panel includes four pairs of the snap connectors disposed thereon;

the snap connectors of the flap and the main panel being arranged such that each pair of the snap connectors of the flap is cooperatively engageable to a respective one of the four pairs of the snap connectors disposed on the rear surface of the main panel.

5. The auto minor of claim 1 wherein the support member has a generally semi-spherical, dome-like configuration, and the fastening strip extends diametrically across the support member.

6. The auto minor of claim 5 wherein the support member is fabricated from a hard, foam-like material having a pliable fabric layer stretched thereover.

7. The auto minor of claim 6 wherein the flap includes a patch of hook and loop fastening material which is releasably engageable to the fabric layer of the support member when the flap is advanced between the fastening strip and the support member.

8. The auto minor of claim 1 wherein the mounting strap defines opposed inner and outer surfaces, and includes a patch of hook and loop fastening material which is attached to the inner surface thereof and releasably engageable to a portion of the outer surface to maintain the mounting strap in a looped arrangement about the headrest.

9. An infant viewing auto minor for attachment to a headrest on a rear vehicle seat, the auto mirror comprising:

a main panel having opposed front and rear surfaces, at least a portion of the front surface being reflective;

a flap attached to the rear surface of the main panel; and a mounting strap removably attachable to the headrest, the mounting strap comprising a support member having a fastening strip extending thereacross;

the flap being advanceable between the fastening strip and the support member to facilitate the cooperative engagement of the main panel to the mounting strap which is sized and configured to allow the main panel to be maintained in any one of a multiplicity of differing angular orientations relative thereto.

10. The auto mirror of claim 9 wherein the flap is releasably attached to the rear surface of the main panel.

11. The auto minor of claim 10 wherein:

the flap includes a plurality of snap connectors disposed thereon; and the rear surface of the main panel includes a plurality of snap connectors disposed thereon;

the cooperative engagement of the snap connectors of the flap to respective ones of the snap connectors of the main panel facilitating the releasable attachment of the flap to the main panel.

12. The auto mirror of claim 11 wherein:

the flap includes two pairs of the snap connectors disposed thereon; and the rear surface of the main panel includes four pairs of the snap connectors disposed thereon;

the snap connectors of the flap and the main panel being arranged such that each pair of the snap connectors of the flap is cooperatively engageable to a respective one of the four pairs of the snap connectors disposed on the rear surface of the main panel.

13. The auto minor of claim 9 wherein the support member has a generally semi-spherical, dome-like configuration, and the fastening strip extends diametrically across the support member.

14. The auto minor of claim 13 wherein the support member is fabricated from a hard, foam-like material having a pliable fabric layer stretched thereover.

15. The auto mirror of claim 14 wherein the flap includes a patch of hook and loop fastening material which is releasably engageable to the fabric layer of the support member when the flap is advanced between the fastening strip and the support member.

16. The auto mirror of claim 9 wherein the mounting strap defines opposed inner and outer surfaces, and includes a patch of hook and loop fastening material which is attached to the inner surface thereof and releasably engageable to a portion of the outer surface to maintain the mounting strap in a looped arrangement about the headrest.

* * * * *